US005472355A

United States Patent [19]

Wittmann

[11] Patent Number: 5,472,355

[45] Date of Patent: Dec. 5, 1995

[54] CABLE CONNECTOR RETAINING BRACKET

[75] Inventor: Glenn E. Wittmann, Downingtown, Pa.

[73] Assignee: Unisys Corporation, Blue Bell, Pa.

[21] Appl. No.: 316,160

[22] Filed: Sep. 29, 1994

[51] Int. Cl.[6] ..... H01R 13/62

[52] U.S. Cl. ..... 439/373

[58] Field of Search ..... 439/359, 367, 439/369, 371, 373

[56] References Cited

U.S. PATENT DOCUMENTS

| | | | |
|---|---|---|---|
| 1,938,303 | 12/1933 | Tregoning | 173/322 |
| 2,063,038 | 12/1936 | Hubbell, Jr. | 173/322 |
| 2,406,030 | 8/1946 | O'Brien | 439/373 |
| 2,930,022 | 3/1960 | Webster . | |
| 3,098,115 | 7/1963 | Guarnaschelli | 174/102 |
| 3,148,928 | 9/1964 | Noschese et al. . | |
| 3,200,365 | 8/1965 | Carpinone . | |
| 3,360,766 | 12/1967 | Schumacher . | |
| 3,406,374 | 10/1968 | Martin . | |
| 3,428,936 | 2/1969 | Arnao, Jr. . | |
| 5,348,495 | 9/1994 | Kasden | 439/373 X |

OTHER PUBLICATIONS

Export Designer's Reference & Catalog #8 by: 1993 Panel Components Corporation© (Power Components for Electrical & Electronic Equipment) 4 pages.

*Primary Examiner*—Khiem Nguyen

*Attorney, Agent, or Firm*—Robert R. Axenfeld; Mark T. Starr

[57] ABSTRACT

A bracket for mechanically securing to a chassis of an electrical device a cable connector plugged into a socket on the chassis has a first generally U-shaped member and a second generally U-shaped member disposed in facing relation for receiving and engaging the connector therebetween. A first fastener connects the first member to the second member so that the connector is captured between the first and second members and a second fastener secures at least one of the first and second members to the chassis of the electrical device proximate the socket, such that the connector is mechanically secured to the chassis of the electrical device.

12 Claims, 1 Drawing Sheet

CABLE CONNECTOR RETAINING BRACKET

FIELD OF THE INVENTION

The present invention relates to a device for securing a cable connector to an electrical device, and more particularly to a bracket for mechanically securing a power cord connector to a power inlet receptacle of an electrical device.

BACKGROUND OF THE INVENTION

Many electrical devices, such as personal computer systems, are supplied power by way of a power cord which interconnects the electrical device to a common electrical outlet. Generally, the power cord is of the type having a three-prong male connector at one end for plugging into the electrical outlet and a three-prong female connector at an opposite end. The female connector is plugged into a complementary three prong male connector located within an inlet on the chassis of the electrical device. The power cord is often a molded power cords having a molded three prong female connector for being received within the inlet on the chassis of the electrical device. The geometric shape of the molded portion of the connector often varies from device to device and from country to country, for example from triangular or rectangular to other polygonal shapes. Having the power cord received within a recess on the chassis relieves strain on the power cord. However, although this arrangement relieves some strain on the power cord, the power cord may still become loose or disconnected due to inadvertent pulling or movement of the power cord or chassis. Disconnection of the power cord causes the electrical device to shut-off. Device shut-off can have severe consequences, especially if the device is a computer system. Sudden, unexpected loss of power and system shut-off, in addition to being inconvenient, can cause, among other things, a loss of data and/or file corruption.

Prior art cord clamps are known which receive the power cord adjacent to the power cord connector, gripping the cord itself, and include a screw fastener for securing the clamp to the connector. Cord clamps are also known for securing power cord electrical connectors and molded power cord connectors to an electrical device. However, these clamps are specially designed for a specific size and shape of molded power cord or connector style and allow for little, if any variation in the size of the molded connector. Thus, there exists a need for a connector clamp which can mechanically secure a molded power cord connector to an electrical device and can accommodate a variety of power cord connector designs and sizes.

SUMMARY OF THE INVENTION

The present invention provides a retaining bracket for mechanically securing a cable connector to a chassis of an electrical device. The bracket has a particularly simple and inexpensive construction which, in addition to securing the cable connector in position, maintains the connector in optimum electrical contact with the electrical device and relieves strain on the cable. The bracket prevents inadvertent signal loss due to failure of the cable connection at the chassis of the electrical device.

Briefly stated, the present invention comprises a bracket for mechanically securing to a chassis of an electrical device a cable connector received in a socket in the chassis. The bracket comprises a first generally U-shaped member and a second generally U-shaped member disposed in facing relation for receiving and engaging the connector therebetween. A first connecting means is provided for connecting the first member to the second member so that the connector is captured between the first and second members and a second connecting means is provided for securing at least one of the first and second members to the chassis of the electrical device proximate the socket, such that the bracket mechanically secures the connector to the electrical device.

BRIEF DESCRIPTION OF THE DRAWING

The foregoing summary, as well as the following detailed description of a preferred embodiment of the invention, will be better understood when read in conjunction with the appended drawing. For the purpose of illustrating the invention, there is shown in the drawing embodiments which are presently preferred. It should be understood, however, that the invention is not limited to the precise arrangement and instrumentality shown. In the drawing.

DETAILED DESCRIPTION OF THE PREFERRED EMBODIMENT

Certain terminology is used in the following description for convenience only and is not limiting. The words "inwardly" and "outwardly" refer to directions towards and away from, respectively, the geometric center of the power cord retaining bracket and designated parts thereof. The terminology includes the words above specifically mentioned, derivatives thereof and words of similar import.

Figure 1:
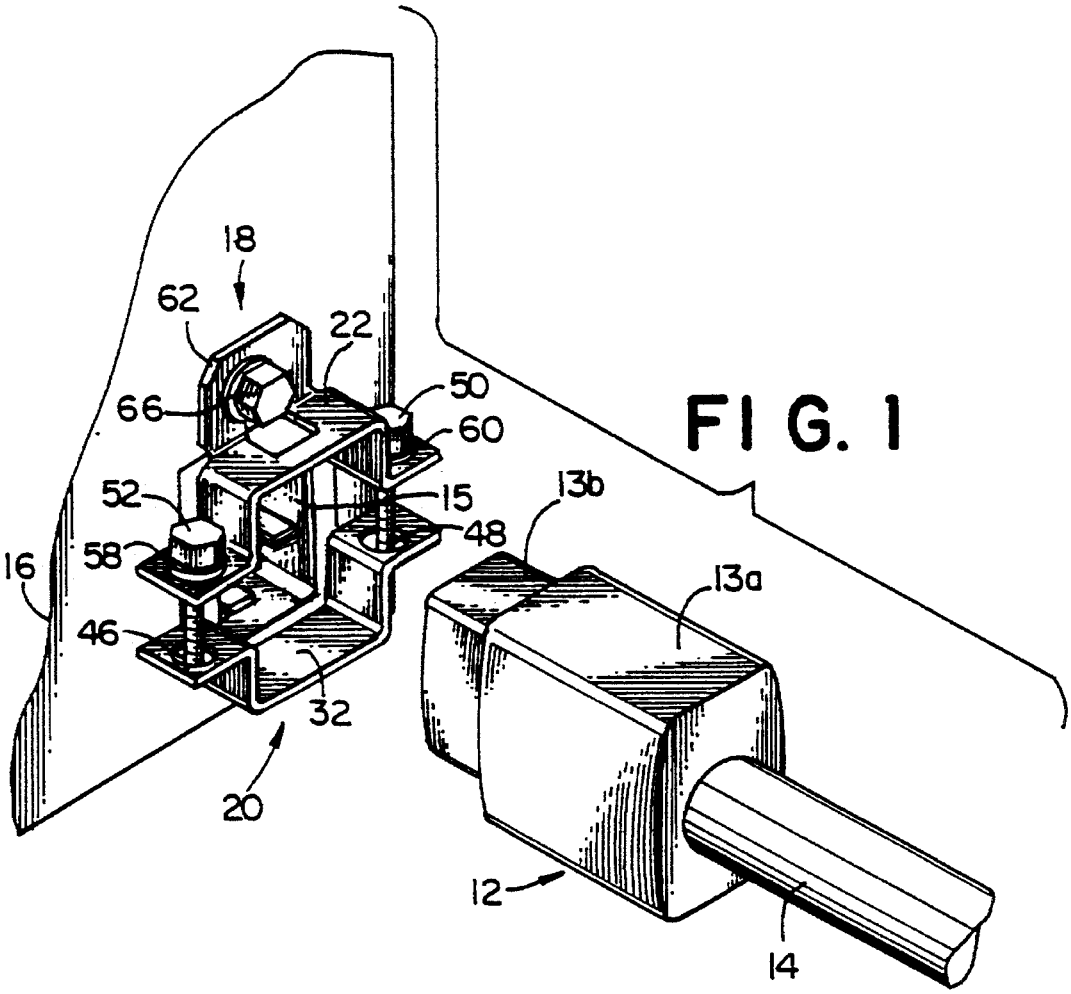
FIG. 1 is a perspective view of a cable connector retaining bracket secured to a chassis of an electrical device in accordance with the present invention.
Figure 2:
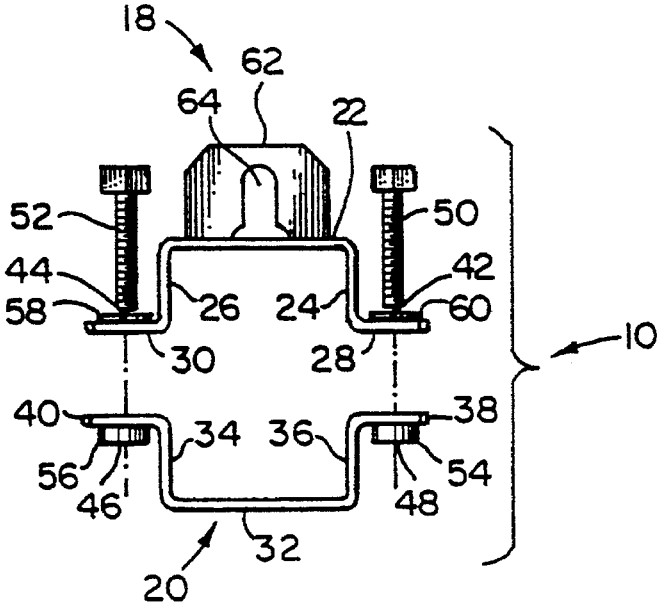
FIG. 2 is a front elevational view of the cable connector retaining bracket of FIG. 1.

Referring to the drawing in detail, wherein like numerals indicate like elements throughout, there is shown in FIGS. 1 and 2 a preferred embodiment of a cable connector retaining bracket, generally designated 10, in accordance with the present invention, for mechanically securing a connector 12 of a cable 14 to a chassis 16 of an electrical device. The bracket 10 provides a secure mechanical connection of the cable connector 12 to the chassis 16, thereby insuring a good electrical connection between the connector 12 and the electrical device. Although the bracket 10 is particularly useful for securing a molded power cord connector 12 to a chassis of a computer system, it will be apparent to those of ordinary skill in the art that the bracket 10 can be used to secure any other type of cable connector to other types of electrical devices. Thus, although the invention will be described herein in conjunction with a particular electrical device, i.e. a computer, and a particular cable, i.e. a power cord, the bracket 10 can be used in conjunction with other electrical devices and cables without departing from the scope of the invention.

FIG. 1 is a perspective view of the cable connector retaining bracket 10 in accordance with the present invention. The molded power cord connector 12 includes a first portion 13*a* and a second portion 13*b*. The second portion 13*b* is of generally smaller dimension than the first portion 13*a* and is adapted to be received within a recessed socket 15 located on the chassis 16, such that when the cable 14 is connected to the electrical device, the second portion 13*b* of the connector 12 extends beyond the surface of the chassis 16 (into the chassis 16) and the first portion 13*a* of the connector 12 protrudes from the chassis 16. The bracket 10 is designed to engage and capture the first portion 13*a* of the connector 12 and secure it to the chassis 16.

The bracket 10 includes first and second generally U-shaped members 18, 20. In the preferred embodiment, each member 18, 20 is which is an integral unit which can be stamped or folded into the shape shown in FIGS. 1 and 2. The first and second members 18, 20 are preferably made to be rigid, so that they do not bend easily. This allows the bracket 10 to provide a strong mechanical connection between the chassis 16 and the connector 12. In the presently preferred embodiment, the first and second members 18, 20 are formed of stainless steel. However, it will be apparent to those of ordinary skill in the art from this disclosure that other metal, metal alloys, or polymeric materials can be used to form the first and second members 18, 20.

The first U-shaped member 18 comprises a bight portion 22 having oppositely disposed ends and first and second legs 24, 26 which are generally perpendicular to the bight portion 22 and disposed at opposite ends of the bight portion 22. Each leg 24, 26 has a flange 28, 30 at its distal end which is generally perpendicular to the leg 24, 26, respectively, and extends outwardly therefrom. The second U-shaped member 20, like the first U-shaped member 18, also comprises a bight portion 32 having oppositely disposed ends and first and second legs 34, 36 which are generally perpendicular to the bight portion 32 and disposed at opposite ends of the bight portion 32. Each leg 34, 36 has a flange 38, 40 at its distal end which is generally perpendicular to the leg 34, 36, respectively, and extends outwardly therefrom. Although the legs 24, 26, 34, 36 are generally perpendicular to the bight portions 22, 32, it will be apparent to those of ordinary skill in the art that the angle formed at the juncture of the legs 24, 26, 34, 36 and the bight portions 22, 32, respectively, could be greater than or less than 90 degrees. The bight portion 22, 32 is sized and shaped to receive a molded cable connector 12 having a generally flat outer surface, although the bight portion 22, 32 could be sized and shaped to receive cable connectors 12 having various geometric shapes and of varying dimensions. In the presently preferred embodiment, the bight portion 22, 32 of each U-shaped member 18, 20 is generally the same and measures approximately 0.94 inches in length and approximately 0.50 inches in width. The legs 24, 26, 34, 36 are all generally the same dimensions and, like the bight portion 22, 32, are sized and shaped to accommodate a molded connector having generally flat surfaces. In the presently preferred embodiment, each leg 24, 26, 34, 36 is approximately 0.40 inches in length and approximately 0.40 inches in width. However, the dimension of each leg 24, 26, 34, 36 could be varied to relate to different sized molded connectors.

As can be seen in FIGS. 1 and 2, the first and second U-shaped members 18, 20 are disposed in facing relation so that the molded connector 12 can be placed and securely held therebetween. In order to securely hold the connector 12 between the U-shaped members 18, 20, the bracket 10 also comprises a first connecting means for connecting the first member 18 to the second member 20. In the presently preferred embodiment, each flange 28, 30, 38, 40 includes a through hole 42, 44, 46, 48 and the first connecting means comprises a pair of fasteners. The fasteners in the illustrated embodiment comprise first and second bolts 50, 52. The bolts 50, 52 extend through the holes 42, 48 and 44, 46 in flanges 28, 38 and 30, 40 respectively, which are in facing relationship. First and second nuts 54, 56 threadedly receive and engage the first and second bolts 50, 52, respectively, such that when the bolts 50, 52 are tightened, the flanges 28, 38 and 30, 40 are securely held in facing engagement. Thus, the first connecting means permits the first member 18 to be securely affixed to the second member 20 and to securely hold the connector 12 therebetween. Although nuts 54, 56 and bolts 50, 52 are used in the presently preferred embodiment, it will be apparent to one of ordinary skill in the art that other suitable fasteners can be used, such as other threaded fasteners, rivets, or the like. Further, the size of the fastener and the corresponding size of the through hole will vary depending upon the size of the molded connector 12 to be secured to the electrical device.

The flanges 28, 30 of the first U-shaped member 18 can also include first and second bosses or washers 58, 60 affixed to the outer surface to aid in securely engaging the flanges 28, 38 and 30, 40 together and the nuts 54, 56 may be permanently affixed to the outer surface of the flanges 38, 40 of the second U-shaped member 20 to facilitate securing the first and second members 18, 20 together and so that the bracket 10 can be easily installed or removed. The bolts 50, 52 can be captured and maintained within the flange holes by washers or some other known capture device (not shown). This is especially useful when installing or removing the bracket 10, since a technician may not have the right size fastener or bolt readily accessible.

The bracket 10 further includes a second connecting means for securing at least one of the first and second members 18, 20 to the chassis 16 of the electrical device, such that the bracket 18, 20 mechanically secures the connector 12 to the electrical device. In the presently preferred embodiment, the first U-shaped member 18 includes a tab 62. The tab 62 is shown and described herein as being part of the first U-shaped member 18, however, it will be apparent to those of ordinary skill in the art that the second member 20 could include such a tab. The tab 62 is perpendicular to the bight portion 22 and extends outwardly therefrom. The tab 62 includes a hole or a slot 64 for receiving a second fastener 66, which extends through the hole 64 and into a receiving hole in the chassis 16 of the electrical device. In the presently preferred embodiment, the second fastener 66 comprises threaded fastener, such as a bolt or a screw for extending through the hole 64 in the tab 62 and being received within a threaded opening in the chassis 16 of the electrical device, such that when the fastener 66 is tightened, the U-shaped member 18 with the tab 62 is secured to chassis 16 of the electrical device.

In the presently preferred embodiment, the hole or slot 64 in the tab 62 extends into the bight portion 22 of the U-shaped member 18. This allows the second fastener 66 to be more quickly oriented in position during installation, more easily accessed during removal, and also permits the member 18 to slide up and down (or side to side) to facilitate insertion of the connector 12 in the socket on the chassis 16. Although a threaded bolt 66 is disclosed as the second fastener, it will be apparent to those of ordinary skill in the art that other suitable fasteners may be used.

Although in the presently preferred embodiment, the bracket 10 is used to secure a generally rectangular, 10 amp molded connector 12 to the chassis 16 of a computer system, by providing two separate pieces 18, 20, the bracket 10 can be used to secure other sized and shaped molded power cord or other connectors to an electrical device chassis.

From the foregoing description, it can be seen that the present invention provides a bracket for securing a power cord connector to an electrical device chassis which provides a strong mechanical connection and ensures a good electrical connection between the power cord connector 12 and the power inlet on the chassis is maintained. The bracket 10 provides a practical and efficient means for maintaining a molded power cord connector 12 in electrical connection with the device. Further, the bracket 10 can be easily and efficiently manufactured. It will be appreciated that changes and modifications may be made to the above described embodiment without departing from the inventive concept thereof. Therefore, it is understood that the present invention is not limited to the particular embodiment disclosed, but is intended to include all modifications and changes which are within the scope and spirit of the invention as defined by the appended claims.

I claim:

1. A bracket for mechanically securing to a chassis of an electrical device a cable connector received in a socket in the chassis, the bracket comprising:

a first generally squared U-shaped member and a second generally squared U-shaped member disposed in facing relation for receiving and engaging the connector therebetween;

a first connecting means for connecting the first member to the second member so that the connector is captured between the first and second members; and a second connecting means for securing at least one of the first and second members to the chassis of the electrical device proximate the socket, such that the bracket mechanically secures the connector to the electrical device.

2. A bracket for mechanically securing to a chassis of an electrical device a cable connector received in a socket in the chassis, the bracket comprising:

a first generally squared U-shaped member and a second generally squared U-shaped member disposed in facing relation for receiving and engaging the connector therebetween;

a first fastener for connecting the first member to the second member so that the connector is captured between the first and second members; and a second fastener for securing at least one of the first and second members to the chassis of the electrical device proximate the socket, such that the bracket mechanically secures the connector to the electrical device.

3. The bracket of claim 2 wherein the first member and the second member each comprise a bight portion having oppositely disposed ends and first and second legs which are generally perpendicular to the bight portion and disposed at opposite ends of the bight portion, each leg of each U-shaped member having a flange at its distal end which is generally perpendicular to the leg and extends outwardly therefrom such that the flanges of the first member are facing the flanges of the second member.

4. The bracket of claim 3 wherein the bracket further comprises first and second bolts and each flange includes a hole, wherein the first and second bolts extend through the holes in the flanges which are in facing relationship, respectively, and first and second nuts for threadedly engaging the first and second bolts, respectively, such that the flanges in facing relationship are securely held in facing engagement.

5. The bracket of claim 4 wherein the first and second nuts are affixed to an outer surface of the flanges of one of the members.

6. The bracket of claim 3 wherein one of the first and second members includes a tab extending perpendicularly outwardly from the bight portion, the tab including a hole and wherein the second fastener comprises a threaded fastener for extending through the hole in the tab and being received within a threaded opening in the chassis of the electrical device, such that the member with the tab is secured to chassis of the electrical device.

7. The bracket of claim 6 wherein the hole in the tab extends into the bight portion of the member.

8. The bracket of claim 4 wherein one of the first and second members includes a tab extending perpendicularly outwardly from the bight portion, the tab including a hole, and wherein the second fastener comprises a threaded fastener for extending through the hole in the tab and being received within a threaded opening in the chassis of the electrical device, such that the member with the tab is secured to chassis of the electrical device.

9. A bracket for mechanically securing to a chassis of an electrical device a cable connector received in a socket in the chassis, the bracket comprising:

a first generally U-shaped member and a second generally U-shaped member disposed in facing relation for receiving and engaging the connector therebetween, the first member and the second member each having a bight portion having oppositely disposed ends and first and second legs which are generally perpendicular to the bight portion and disposed at opposite ends of the bight portion, each leg of each U-shaped member having a flange at its distal end which is generally perpendicular to the leg and extends outwardly therefrom such that the flanges of the first member are facing the flanges of the second member, each flange having a hole extending therethrough;

first and second bolts which extend through the flange holes which are in facing relationship, respectively, and first and second nuts for threadedly engaging the first and second bolts, respectively, such that the flanges in facing relationship are securely held in facing engagement and the connector is captured between the first and second members; and a tab extending perpendicularly outwardly from the bight portion of a selected one of the first and second members, the tab including a hole, and a threaded fastener for extending through the hole in the tab and being received within a threaded opening in the chassis of the electrical device, such that the member with the tab is secured to the chassis of the electrical device and the bracket mechanically secures the connector to the electrical device.

10. A method for mechanically securing to a chassis of an electrical device a cable connector received in a socket in the chassis, the method comprising the steps of:

(a) providing a first generally U-shaped member having a bight portion and first and second legs, the first and second legs having first and second flanges at their respective distal ends, the flanges extending outwardly therefrom, wherein each flange includes a through hole and the bight portion of the member includes a tab extending generally perpendicularly outwardly therefrom;

(b) providing a second generally U-shaped member having first and second legs, the first and second legs having first and second flanges at their respective distal ends, the flanges extending outwardly therefrom, wherein each flange includes a through hole;

(c) connecting the cable connector to the socket on the chassis of the electrical device;

(d) placing the first member around a first half of the cable connector;

(e) placing the second member around a second, remaining half of the cable connector such that the flanges of the first and second members are in facing relation and the holes in the facing flanges are aligned;

(f) securing the first member to the second member such that the cable connector is captured therebetween; and (g) securing the first member to the chassis of the electrical device proximate the socket by securing the tab to the chassis, thereby mechanically securing the cable connector to the chassis.

11. The method of claim 10 wherein the step of securing the first member to the second member further comprises using first and second bolts and first and second nuts, the bolts extending through the holes in the facing flanges, respectively.

12. The method of claim 11 wherein the step of securing the first member to the chassis of the electrical device further comprises securing the tab to the chassis with a threaded fastener.

* * * * *